US006487865B1

(12) United States Patent
Luo

(10) Patent No.: US 6,487,865 B1
(45) Date of Patent: Dec. 3, 2002

(54) APPARATUS FOR CONDUCTING THERMAL ENERGY

(76) Inventor: Chin-Kuang Luo, 5F, No. 56, Min-Chuan Rd., Chung Dist., Taichung City (TW)

( * ) Notice: Subject to any disclaimer, the term of this patent is extended or adjusted under 35 U.S.C. 154(b) by 0 days.

(21) Appl. No.: 10/150,196

(22) Filed: May 17, 2002

(30) Foreign Application Priority Data

Feb. 25, 2002 (TW) ..... 091103346 A

(51) Int. Cl.[7] ..... F25B 21/02

(52) U.S. Cl. ..... 62/3.61; 62/3.2; 62/3.6; 62/259.2

(58) Field of Search ..... 62/3.1, 3.2, 3.3, 62/3.6, 3.61, 3.62, 3.7, 259.2

(56) References Cited

U.S. PATENT DOCUMENTS 5,927,078 A * 7/1999 Watanabe et al. ..... 62/3.6

6,038,865 A * 3/2000 Watanabe et al. ..... 62/3.6

FOREIGN PATENT DOCUMENTS

EP 0478204 * 9/1991 ..... 62/3.3

* cited by examiner

*Primary Examiner*—Denise L. Esquivel
*Assistant Examiner*—Melvin Jones
(74) *Attorney, Agent, or Firm*—Trop, Pruner & Hu, P.C.

(57) ABSTRACT

In an apparatus for conducting thermal energy, a thermoelectric unit in thermal communication with a thermal conductor is electrically operable so as to operate in a heat-absorbing mode, where the thermoelectric unit absorbs heat from the thermal conductor to reduce temperature of the thermal conductor, and a heat-radiating mode, where the thermoelectric unit radiates heat to the thermal conductor. A processor is operable so as to enable a power control circuit to control supply of electric power to the thermoelectric unit according to temperature of the thermal conductor and the thermoelectric unit sensed by a temperature sensor when the thermoelectric unit is operated in a selected one of the heat-absorbing mode and the heat-radiating mode.

6 Claims, 6 Drawing Sheets

APPARATUS FOR CONDUCTING THERMAL ENERGY

CROSS-REFERENCE TO RELATED APPLICATION

This application claims priority of Taiwan patent Application No. 091103346, filed on Feb. 25, 2002.

BACKGROUND OF THE INVENTION

1. Field of the Invention

The invention relates to the art of thermal energy conduction, more particularly to an apparatus for conducting thermal energy.

2. Description of the Related Art

In a co-pending U.S. patent application Ser. No. 09/951,174, entitled "FLUID CONDUIT WITH ENHANCE THERMAL CONDUCTING ABILITY", filed by the applicant of this application, there is disclosed an apparatus for conducting thermal energy.

The object of the present invention is to provide an apparatus for conducting thermal energy that permits heat-absorbing and heat-radiating control in a highly efficient manner.

SUMMARY OF THE INVENTION

According to the present invention, an apparatus for conducting thermal energy comprises:

a thermal conductor including a hollow heat-conducting member that has inner and outer walls confining an enclosed chamber therebetween, and a superconductor that fills the chamber;

a thermoelectric unit disposed on and in thermal communication with the outer wall of the heat-conducting member, the thermoelectric unit being electrically operable so as to operate in a heat-absorbing mode, where the thermoelectric unit absorbs heat from the thermal conductor so as to reduce temperature in the heat-conducting member, and a heat-radiating mode, where the thermoelectric unit radiates heat to the thermal conductor;

a temperature sensor connected to the thermal conductor and the thermoelectric unit for sensing temperature thereof;

a power control circuit connected to the thermoelectric unit for controlling supply of electric power thereto; and a processor connected to the temperature sensor and the power control circuit, the processor being operable so as to enable the power control circuit to control supply of the electric power to the thermoelectric unit according to the temperature sensed by the temperature sensor when the thermoelectric unit is operated in a selected one of the heat-absorbing mode and the heat-radiating mode.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
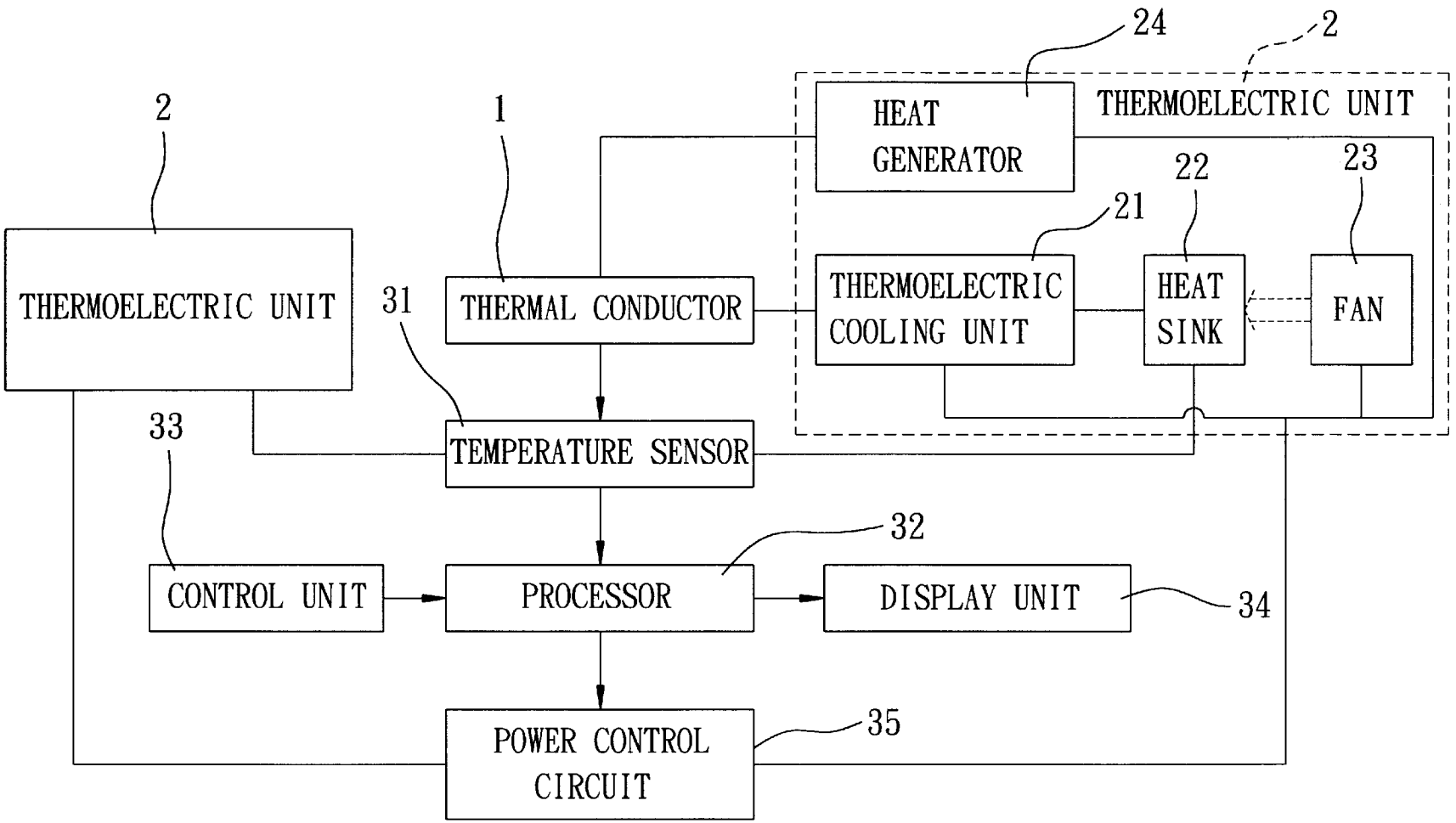
FIG. 1 is a schematic circuit diagram illustrating the preferred embodiment of an apparatus for conducting thermal energy according to this invention.

Before the present invention is described in greater detail, it should be noted that like elements are denoted by the same reference numerals throughout the disclosure.

Referring to FIG. 1, the preferred embodiment of an apparatus for conducting thermal energy according to the present invention is shown to include a thermal conductor 1, a pair of thermoelectric units 2, a temperature sensor 31, a power control unit 35, a display unit 34, and a control unit 33. In this embodiment, the apparatus is applied to a delivery van 6, as shown in FIG. 2.

Figure 2:
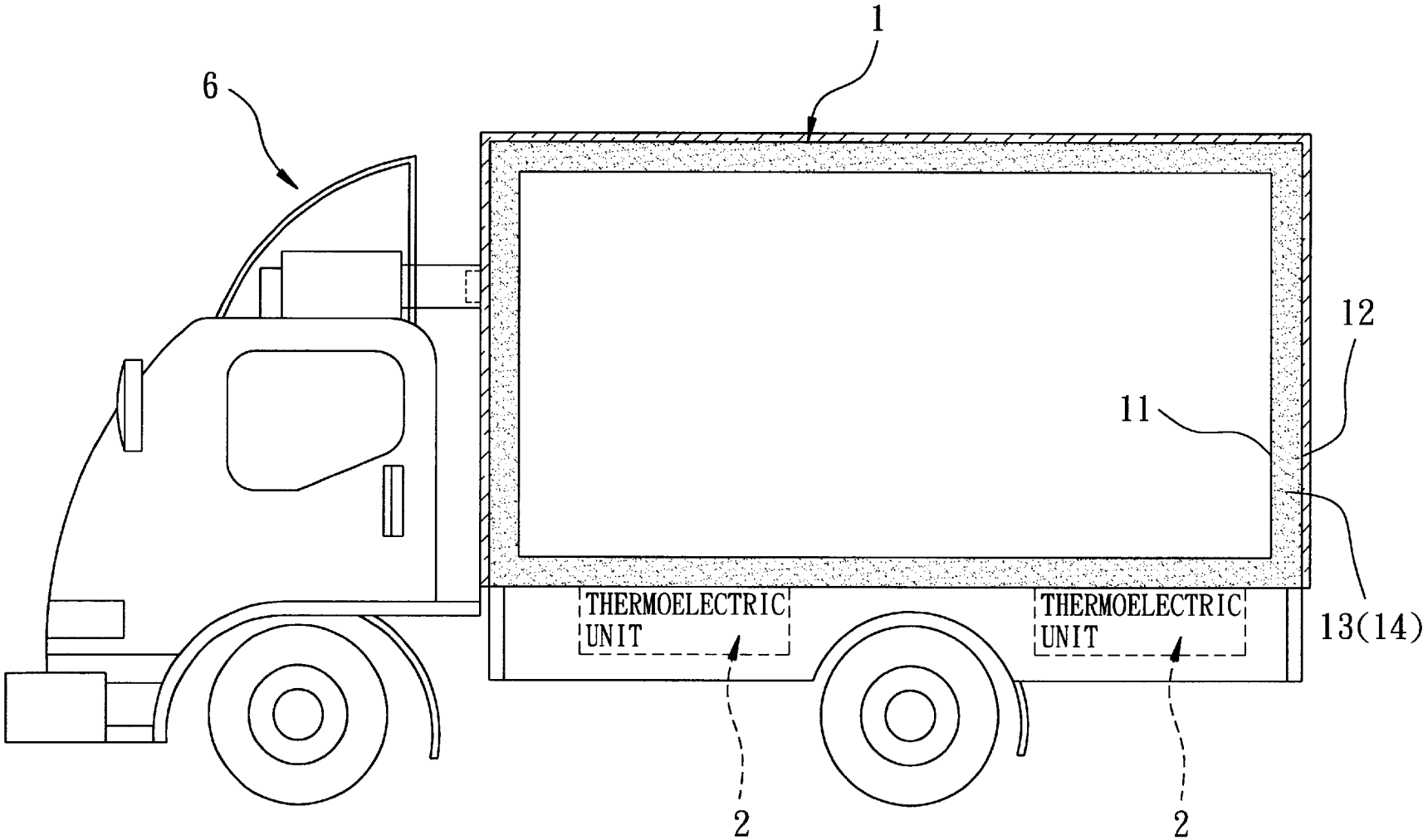
FIG. 2 is schematic partly sectional view showing the preferred embodiment when applied to a delivery van.

The thermal conductor 1 includes a hollow heat-conducting member that is made of aluminum, copper or a metal alloy with excellent heat conducting characteristics, and that has inner and outer walls 11, 12 confining an enclosed chamber 13 therebetween, and a superconductor 14 that fills the chamber 13 in a known manner (see FIG. 2).

Each thermoelectric unit 2 is disposed on and is in thermal communication with the outer wall 12 of the heat-conducting member. Each thermoelectric unit 2 is electrically operable so as to operate in a heat-absorbing mode, where the thermoelectric unit 2 absorbs heat from the thermal conductor 1, and a heat-radiating mode, where the thermoelectric unit 2 radiates heat to the thermal conductor 1. In this embodiment, the thermoelectric unit 2 includes an electrically operable thermal energy source, a heat sink 22 and a fan 23. Preferably, the thermal energy source is a thermoelectric cooling unit 21 that is in contact with the outer wall 12 of the thermal conductor 1. The thermoelectric cooling unit 21 has a heat-absorbing side (not shown), and a heat-radiating side (not shown) opposite to the heat-absorbing side. The heat sink 22 is disposed on the heat-radiating side. The fan 23 is disposed to induce air currents toward the heat sink 22.

The temperature sensor 31 is connected to the thermal conductor 1 and the heat sink 22 of the thermoelectric unit 2 for sensing temperature thereof.

The power control circuit 35 is connected to the thermoelectric cooling unit 21 and the fan 23 of the thermoelectric units 2 for controlling supply of electric power thereto.

The processor 32 is connected to the temperature sensor 31 and the power control circuit 35. The processor 32 is operable so as to enable the power control circuit 35 to control supply of the electric power to the thermoelectric cooling unit 21 and the fan 23 of the thermoelectric units 2 according to the temperature sensed by the temperature sensor 31 when the thermoelectric units 2 are operated in a selected one of the heat-absorbing mode and the heat-radiating mode.

The display unit 34, in the form of two seven-segment displays, is connected to the processor 32 for displaying temperature information of the thermal conductor 1.

The control unit 33 is connected to the processor 32, and is manually operable so as to provide control signals for enabling the processor 32 to control the power control circuit 35 in order to operate the thermoelectric units 2 in the selected one of the heat-absorbing mode and the heat-radiating mode. In this embodiment, the control unit 33 includes a power switch 351, a pair of temperature control keys 333, and a pair of operating mode control keys 331, 332 mounted on a control panel 3 (see FIG. 3). In this embodiment, the temperature control keys 333 can be adjusted in a temperature range of 0° C.~15° C. when the thermoelectric units 2 are operated in the heat-absorbing mode and in a temperature range of 40° C.~70° C. when the thermoelectric units 2 are operated in the heat-radiating mode.

Each thermoelectric unit 2 further includes a heat generator 24 connected to the power control circuit 35 and in heat conducting contact with the outer wall 12 of the heat-conducting member. The heat generator 24 is controlled by the power control circuit 35 so as to generate heat when the thermoelectric unit 2 is operated in the heat-radiating mode.

Figure 3:
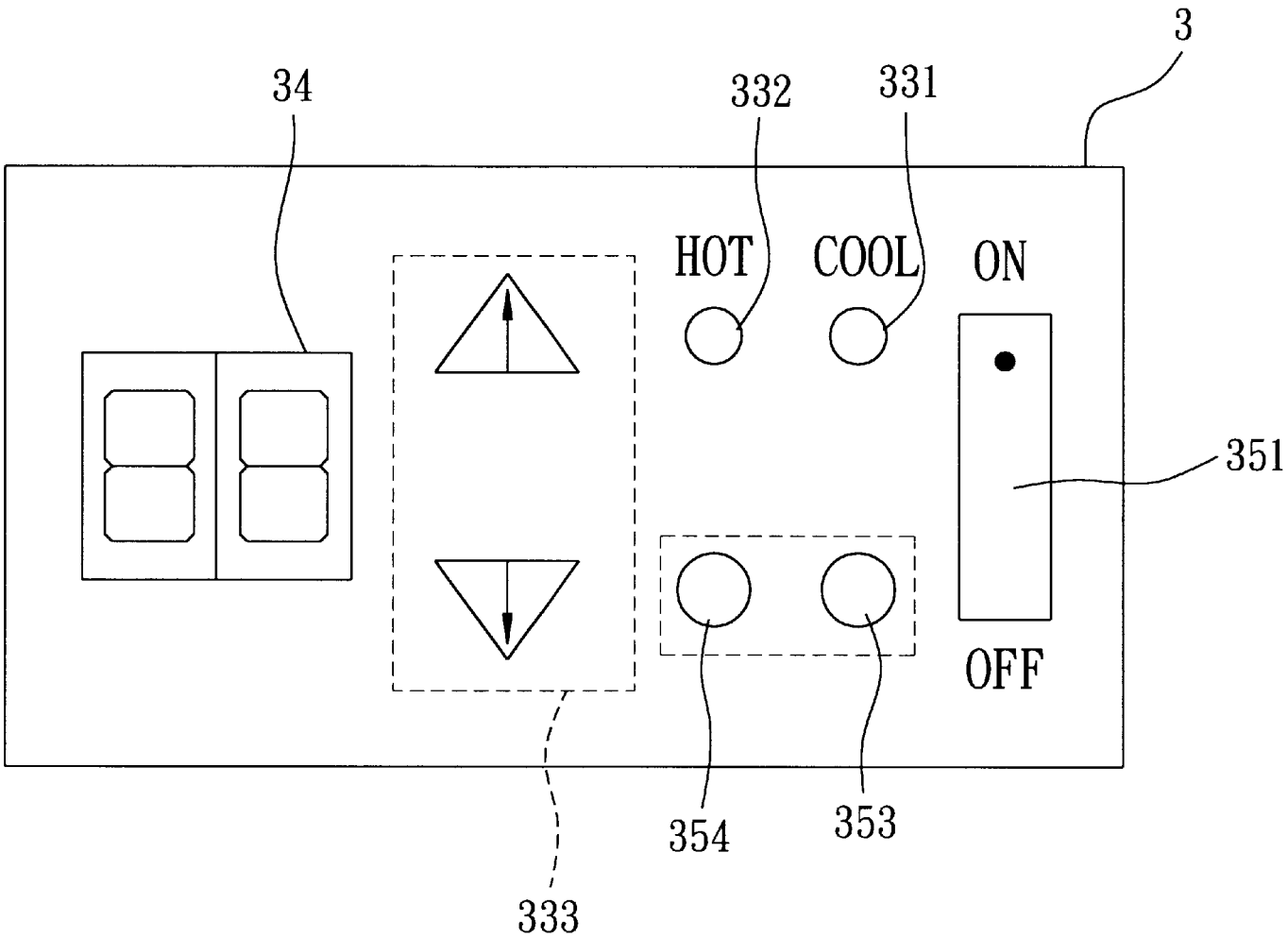
FIG. 3 is a schematic view showing a control panel of the preferred embodiment.

In operation, after the operating mode control key 331 is pressed and the desired temperature of the thermal conductor 1 is set by operating the temperature control keys 333, the thermoelectric units 2 are operated in the heat-absorbing mode (indicated by an indicator 353, such as an LED emitting green light as shown in FIG. 3), and the processor 32 enables the power control circuit 35 to allow supply of the electric power to the thermoelectric units 2 without activating the heat generator 24 until the temperature sensed by the temperature sensor 31 reaches the desired temperature. Accordingly, when the thermoelectric units 2 are operated in the heat-radiating mode (indicated by an indicator 354, such as an LED emitting red light as shown in FIG. 3), the processor 32 enables the power control circuit 35 to allow supply of the electric power to the thermoelectric cooling units 21 and the heat generators 24 without activating the fans 23, wherein the electric power supplied to the thermoelectric cooling units 21 is the inverse of that in the heat-absorbing mode, until the temperature sensed by temperature sensor 31 reaches the desired temperature.

Figure 4:
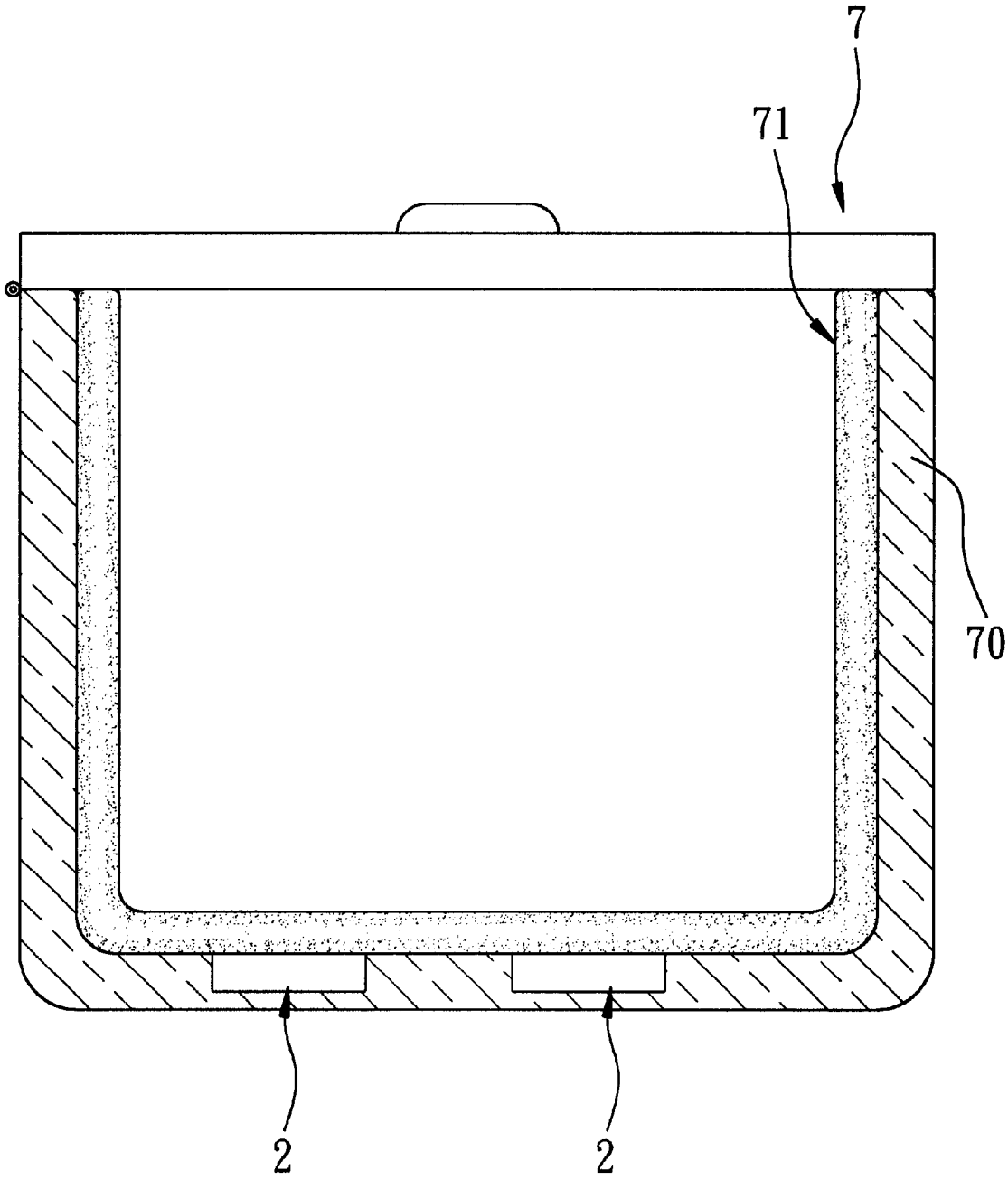
FIG. 4 is a schematic sectional view showing the preferred embodiment when applied to a portable refrigerator.
Figure 5:
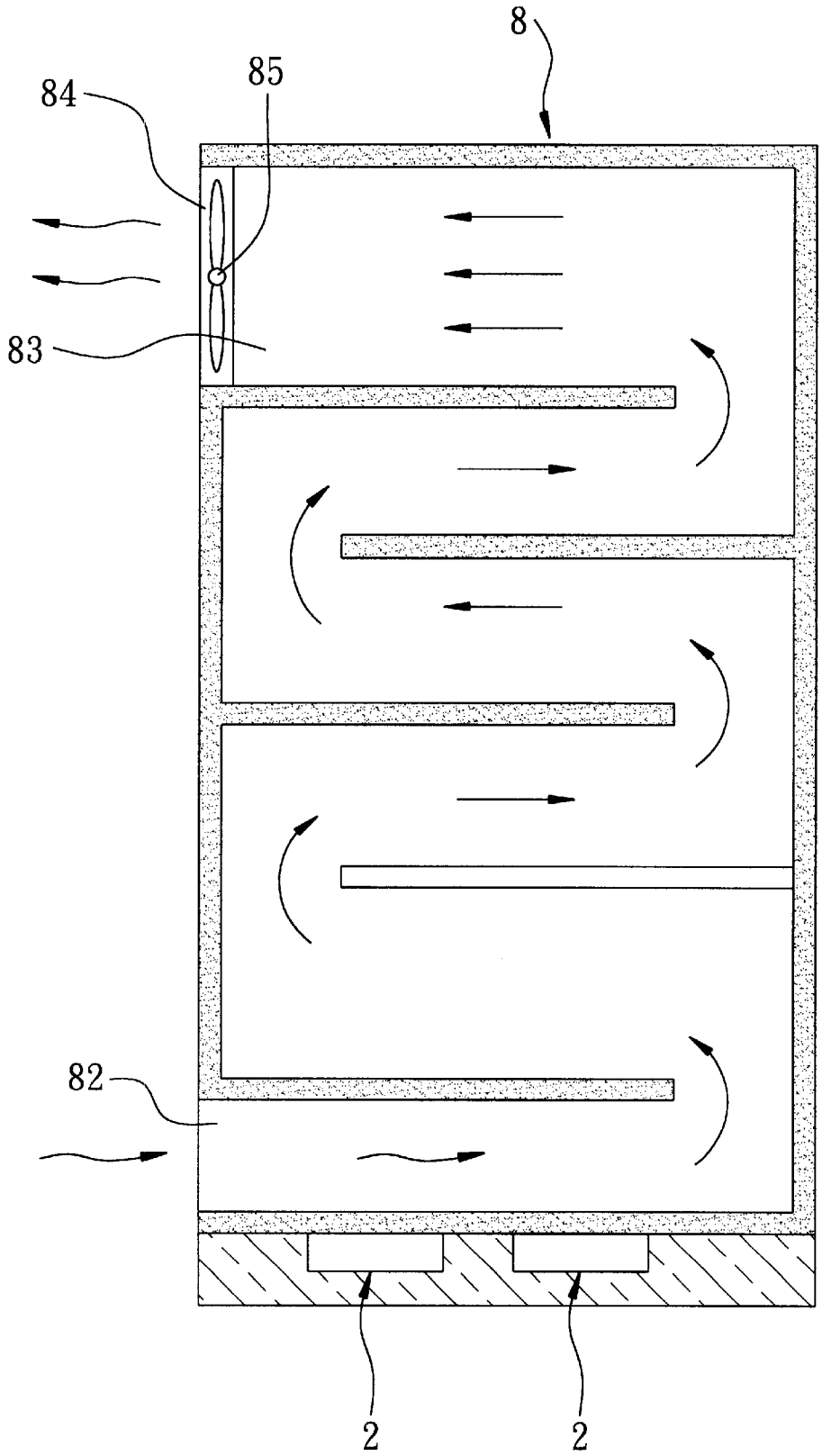
FIG. 5 is a schematic sectional view showing the preferred embodiment when applied to an air conditioning system.
Figure 6:
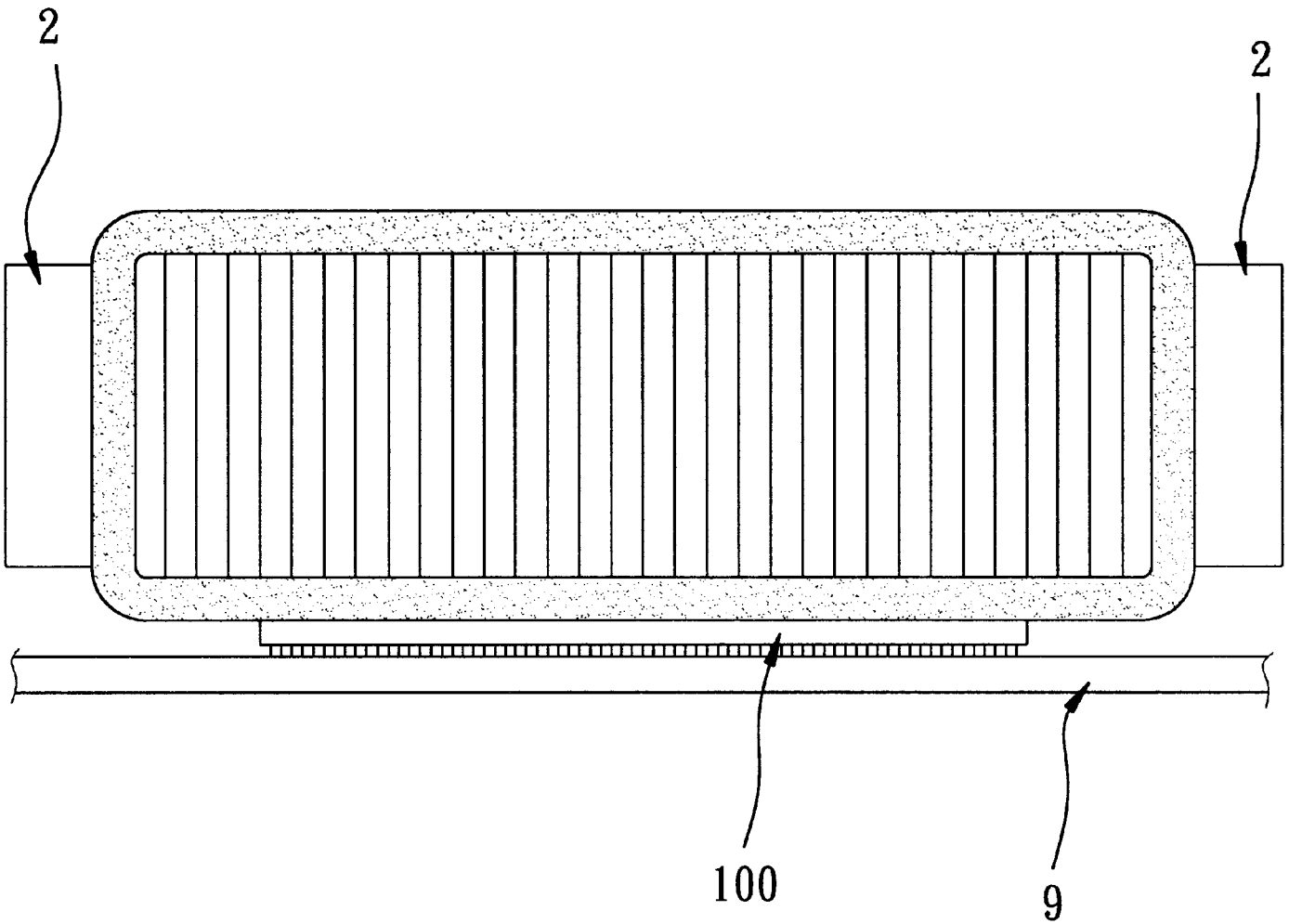
FIG. 6 is a schematic sectional view showing the preferred embodiment when applied to a heat-generating electronic component.

Moreover, referring to FIG. 4, the apparatus for conducting thermal energy of this invention can be applied to a portable refrigerator 7. In the portable refrigerator 7, the thermal conductor 71 is surrounded by an insulator housing 70. Two thermoelectric units 2 are provided on a bottom side of the thermal conductor 71. Referring to FIG. 5, the apparatus for conducting thermal energy of this invention can be further applied to an air conditioning system 8. In the air conditioning system 8, the heat-conducting member has an air inlet 82, an air outlet 84, and an air conduit 83 communicating the air inlet 82 and the air outlet 84. A fan 85 is disposed in the air outlet 84. Two thermoelectric units 2 are disposed on a bottom side of the heat-conducting member. As shown in FIG. 6, the apparatus for conducting thermal energy of this invention can be further applied to serve as a heat dissipating device for dissipating heat generated by a central processing unit 100 mounted on a circuit board 9. In the heat dissipating device, a pair of thermoelectric units 2 are disposed on opposite lateral sides of the thermal conductor.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An apparatus for conducting thermal energy, comprising:

a thermal conductor including a hollow heat-conducting member that has inner and outer walls confining an enclosed chamber therebetween, and a superconductor that fills said chamber;

a thermoelectric unit disposed on and in thermal communication with said outer wall of said heat-conducting member, said thermoelectric unit being electrically operable so as to operate in a heat-absorbing mode, where said thermoelectric unit absorbs heat from said thermal conductor so as to reduce temperature in said heat-conducting member, and a heat-radiating mode, where said thermoelectric unit radiates heat to said thermal conductor;

a temperature sensor connected to said thermal conductor and said thermoelectric unit for sensing temperature thereof;

a power control circuit connected to said thermoelectric unit for controlling supply of electric power thereto; and a processor connected to said temperature sensor and said power control circuit, said processor being operable so as to enable said power control circuit to control supply of the electric power to said thermoelectric unit according to the temperature sensed by said temperature sensor when said thermoelectric unit is operated in a selected one of the heat-absorbing mode and the heat-radiating mode.

2. The apparatus as claimed in claim 1, wherein said thermoelectric unit includes an electrically operable thermal energy source in contact with said outer wall of said heat-conducting member and connected to said power control circuit, said thermal energy source having a heat-absorbing side, and a heat-radiating side opposite to said heat-absorbing side, a heat sink disposed on said heat-radiating side, and a fan connected to said power control circuit and disposed to induce air currents toward said heat sink.

3. The apparatus as claimed in claim 2, wherein said thermal energy source is a thermoelectric cooling unit.

4. The apparatus as claimed in claim 1, further comprising a control unit connected to said processor, said control unit being manually operable so as to provide control signals for enabling said processor to control said power control circuit in order to operate said thermoelectric unit in the selected one of the heat-absorbing mode and the heat-radiating mode.

5. The apparatus as claimed in claim 1, further comprising a display unit connected to said processor for displaying temperature information of said thermal conductor.

6. The apparatus as claimed in claim 2, wherein said thermoelectric unit further includes a heat generator connected to said power control circuit and in heat conducting contact with said outer wall of said heat-conducting member, said heat generator being controlled by said power control circuit so as to generate heat when said thermoelectric unit is operated in the heat-radiating mode.

* * * * *